United States Patent [19]

Berghahn

[11] Patent Number: 4,485,915

[45] Date of Patent: Dec. 4, 1984

[54] CHILD RESISTANT TABLET PACKAGE

[75] Inventor: Walter G. Berghahn, Scotch Plains, N.J.

[73] Assignee: Bristol-Myers Company, New York, N.Y.

[21] Appl. No.: 551,390

[22] Filed: Nov. 14, 1983

[51] Int. Cl.[3] ..... A45C 13/10

[52] U.S. Cl. ..... 206/1.5; 206/528; 206/532; 220/281; 220/345

[58] Field of Search ..... 206/528, 531, 532, 534.1, 206/534.2, 538, 1.5; 220/306, 309, 281, 345

[56] References Cited

U.S. PATENT DOCUMENTS

| | | | |
|---|---|---|---|
| 1,772,744 | 8/1930 | Barry . | |
| 1,822,576 | 9/1931 | Greve . | |
| 1,984,351 | 12/1934 | Johnson | 206/531 |
| 2,024,227 | 12/1935 | Jones | 220/281 |
| 2,560,376 | 7/1951 | Waterman | 206/528 |
| 2,686,627 | 8/1954 | McElwee | 229/19 |
| 3,051,366 | 8/1962 | Sandstrom | 229/9 |
| 3,201,064 | 8/1965 | Dagle et al. | 220/345 |
| 3,504,788 | 4/1970 | Gray | 206/42 |
| 3,568,827 | 3/1971 | Hertag | 206/1.5 |
| 3,630,344 | 12/1971 | Bergh et al. | 220/345 |
| 3,888,350 | 6/1975 | Horvath | 206/531 |
| 3,987,891 | 10/1976 | Horvath | 206/1.5 |
| 4,007,828 | 2/1977 | Mayled | 206/1.5 |
| 4,120,400 | 10/1978 | Kotyuk | 206/528 |
| 4,192,422 | 3/1980 | Kotyuk | 206/528 |
| 4,401,210 | 8/1983 | Anjou | 220/281 |

*Primary Examiner*—Joseph Man-Fu Moy
*Attorney, Agent, or Firm*—Gabriel P. Katona

[57] ABSTRACT

A child resistant package having an outer container and an inner product supporting tray; the inner tray is adapted to be inserted into the container to a locked position and removed therefrom by disengaging a locking means and withdrawing the tray; the inner tray is disengaged from the container by pressing inwardly a pair of flexible tabs formed at the back end of the side walls of the tray; in a preferred embodiment a blister pack containing tablets is disposed on the product tray and the tray bottom is provided with holes through which the tablets in the blister pack may be pushed.

7 Claims, 7 Drawing Figures

CHILD RESISTANT TABLET PACKAGE

This invention relates to child resistant packages and, more particularly, to tablet blister packages of this type that are pocket size. These may be carried about conveniently in a pocket or handbag.

Packaging tablets or the like in so-called blister packs has become a widely accepted mode for packaging and dispensing tablets. However, with the emphasis now being placed on safety in packaging, attempts have been made to make these packages more child resistant, i.e. to design them so that they would resist entry into the package by children and, particularly, small children (e.g. 40 months and under).

Child resistant blister packages presently on the market generally work on a "difficult to open" blister principle. That is to say, that the child resistant feature is dependent on making it difficult for the child to open the blister pack. However, in order to keep children out of the package, it became necessary to make it so difficult to open the package so as to make it also objectionable to adults.

The present invention takes another basic approach to the problem. Rather than increasing the difficulty of opening the blister pack, it is left essentially the same as the so-called "push-through" packages that have been very acceptable to the consumer. In its place, however, applicant provides a slide flat container of pocket size in which the blister pack may be disposed and into which the child deterrent feature is built.

It is accordingly an object of the present invention to provide a child resistant blister package of pocket size which avoids the difficulties of prior art packages of this type mentioned above.

It is also an object of this invention to provide a slide flat container of pocket size in which a blister pack may be disposed and into which a child deterrent feature is built.

Other and more detailed objects of this invention will be apparent from the following description, drawings and claims.

Figure 1:
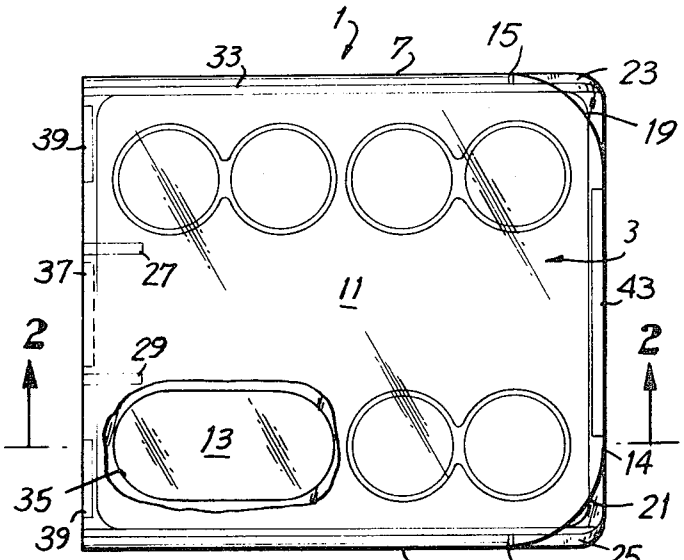
FIG. 1 is a top plan view of a child resistant package embodied in the present invention, the modification illustrated being fabricated from a transparent plastic material, part of the roof of the container having been removed as well as the overlying tablet and blister pack to reveal one of the several product openings that are cut in the tray bottom.
Figure 2:
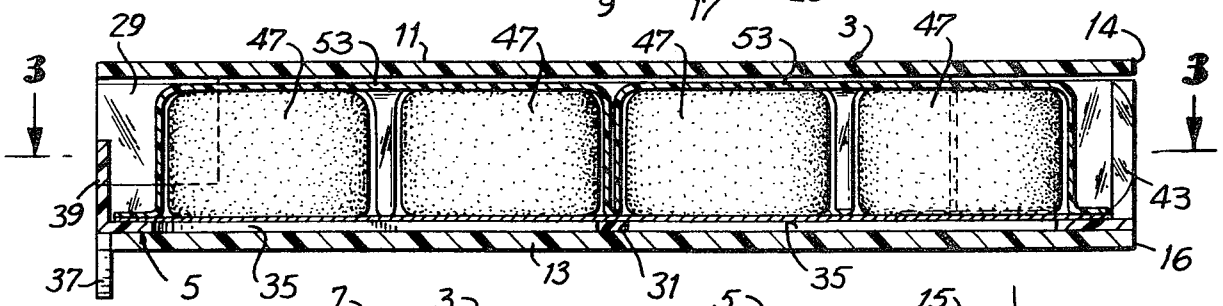
FIG. 2 is a cross-sectional view of the package illustrated in FIG. 1 taken along line 2—2 of FIG. 1, the part of the roof of the container as well as the overlying tablet and blister pack removed from FIG. 1 having been restored.

Referring to the drawings, wherein the same numeral in the various views refers to the same element, a package embodied in this invention is shown generally at 1 and comprises a container 3 and a product supporting tray 5. Container 3 has the form of a sleeve that is open at its front and back and is generally rectangular in cross-section. Container 3 is formed by a pair of side walls 7 and 9, a roof 11 and floor 13 all joined together.

The longitudinal dimension of side walls 7 and 9 are equal to each other but are smaller than the longitudinal dimensions of the container roof 11 and floor 13 respectively. Thus, the back margins 14 and 16 of the container roof and floor respectively are spaced backwardly of the back margin 15 and 17 of said container side walls 7 and 9 respectively.

In the modification illustrated, the back corners of container roof 11 are rounded to form rounded roof portions 19 and 21 respectively. This construction facilitates the grabbing of flexible tabs 23 and 25 on tray 5 in a manner described in more detail below.

Extending downwardly near the front end of container roof 11 there is provided a pair of stops 27 and 29. As described in more detail below, these serve to prevent tray 5 from being pulled all the way out of container 3 when the tray is pulled out of the container to get access to the product.

The product supporting tray 5 is formed with a tray bottom 31 and a pair of upwardly extending tray side walls 33. In the modification illustrated, a plurality of product holes 35 are cut through the tray bottom 31. These are shaped and dimensioned so that the products contained in the blister pack may be pushed through these holes as described below.

Extending downwardly and adjacent the front margin of tray bottom 31 there is provided a pull tab 37. This facilitates the removal of the product tray 5 once the locking means has been disengaged as hereinafter described.

Extending upwardly adjacent the front margin of tray 5 there is disposed a pair of product retaining tabs 39. These prevent blister pack 41 from sliding off tray 5 when the package is held with its front end pointing downwardly.

Figure 4:
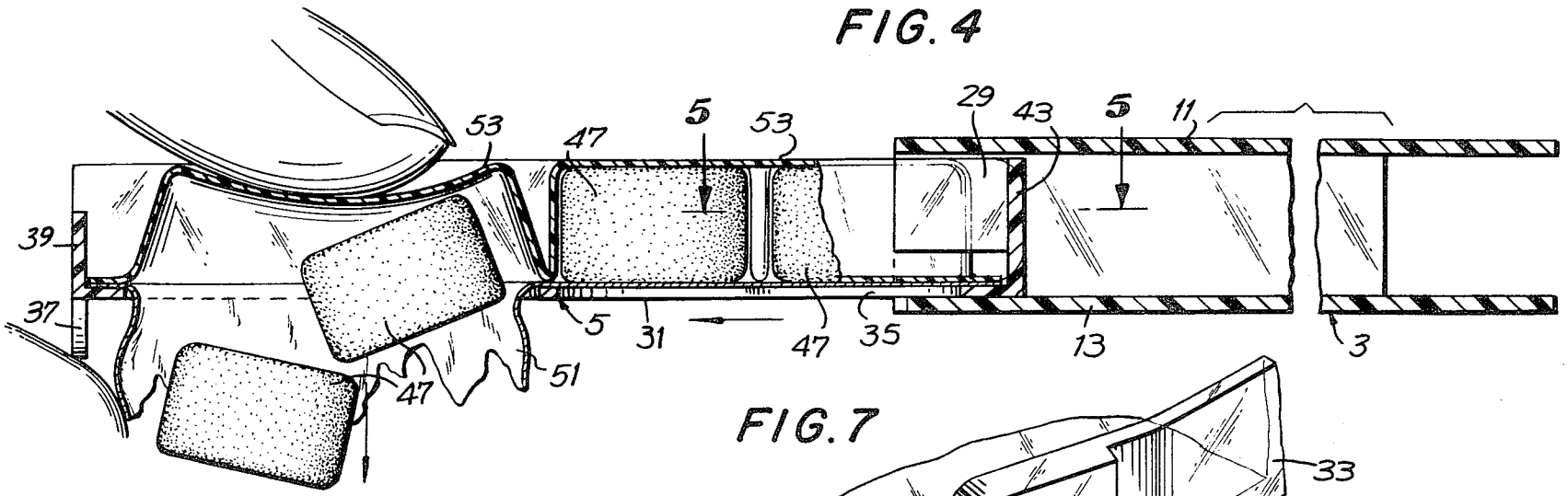
FIG. 4 is a partial cross-sectional view of a package embodied in the present invention similar to that shown in FIG. 2 but showing the tray substantially withdrawn from the container and illustrating how the tablets of this embodiment are pushed out of the blister pack in which they are contained.
Figure 5:
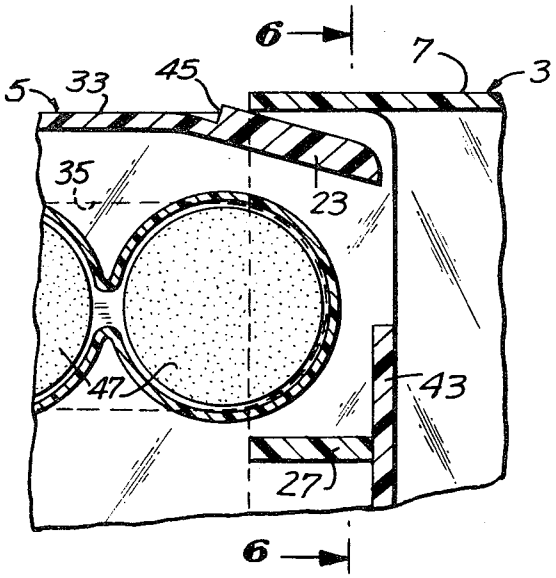
FIG. 5 is a partial sectional view of the package shown in FIG. 4 taken along line 5—5 of FIG. 4 illustrating the position of the flexible tab on the tray when it is withdrawn from the container to the extent shown in FIG. 4.

Projecting upwardly adjacent the rear margin of tray 5 there is located a centrally positioned tray back stop 43. Back stop 43 has several functions. It prevents the blister pack 41 from sliding off tray 5 when the package is held with its back end pointing downwardly. It also serves as a stop when tray 5 is pulled out to its full extent when stop 43 contacts roof stops 27 and 29 of container 3. This is best seen in FIGS. 4 and 5.

As previously indicated, tray 5 is provided with a pair of flexible tabs 23 and 25. These are formed in each of the side walls 33 by cutting a slot through the back margins of side walls 33 near their lower edges. Flexible tabs 23 and 25 are constructed so that they are thicker than and protrude from the side walls 33 on which they are mounted. This is best seen in FIG. 5. The thickening of flexible tabs 23 and 25 forms a ledge 45 at the back end of each of flexible tabs 23 and 25.

It is a feature of the present invention to provide a package that is child resistant. To this end, the package may also be constructed so that it is beyond the capability of the average small child to depress both of the flexible tabs 23 and 25 at the same time. For this purpose, tray 5 is fabricated so that the distance from the outside lateral surface of flexible tab 23 of the outside lateral surface of tab 25 is not less than about 1¾ inches.

In a preferred aspect of this invention, a blister pack 41 containing tablets 47 is positioned in tray 5. In the modification illustrated, the blister pack is designed so that two tablets can be dispensed at a time. This comprises an upper layer 49 made of relatively rigid material and a lower frangible layer 51. The upper layer 49 can be made of any suitable material. The lower frangible layer 51 is preferably made of aluminum foil.

Each pair of tablets is encased in a blister 53 that is secured to upper layer 49 of the blister pack 41 in a manner well known to those skilled in the art. Blister 53 is made of transparent plastic material through which tablets 47 are visible.

Container 3 and tray 5 may be made of any suitable material. Generally, each is molded of a flexible clear or opaque plastic material such as styrene, polypropylene, polyethylene or other appropriate plastic. The materials have sufficient flexibility so that tray 5 may be loaded into container 3 through the back opening thereof. By applying pressure to the side walls of container 3, it is sufficiently deformed so that tray 5 can be inserted into the back opening of container 3 notwithstanding the fact that pull tab 37 extends downwardly from the undersurface of tray 5.

In use, tray 5 is pulled out of container 3 and blister pack 41 is placed on tray 5 with the tablets 47 encased in blister 53 positioned over product holes 35 cut in the bottom of tray 5. To close package 1, tray 5 is pushed inwardly toward the back of container 3. Since the horizontal distance between the outer surfaces of flexible tabs 23 and 25 is greater than the distance between side walls 7 and 9 of the container, tabs 23 and 25 are flexed inwardly. This is best seen in FIG. 5.

Figure 3:
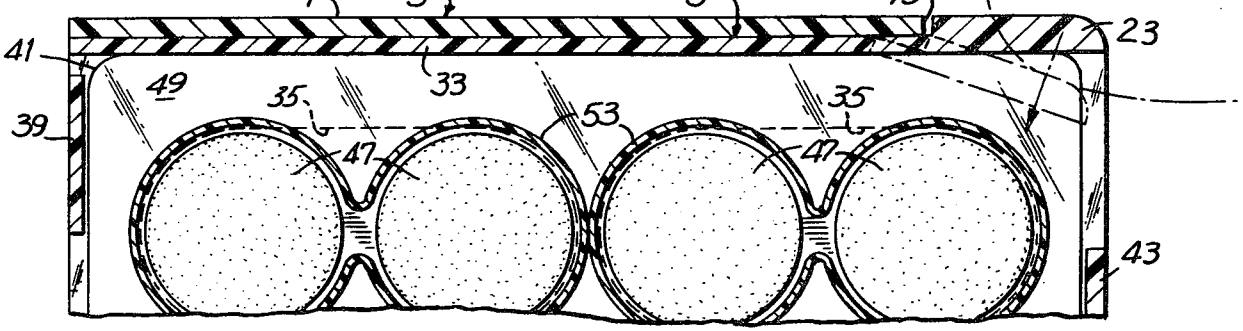
FIG. 3 is a partial cross-sectional view of the package shown in FIG. 2 taken along line 3—3 of FIG. 2, the flexible tab of the tray in its compressed position being shown in dotted line.

When tray 5 is pushed far enough into container 3 so that the back margins 45 of flexible tabs 23 and 25 are beyond the back margins 15 and 17 of container side walls 7 and 9, tabs 23 and 25 spring outwardly locking tray 5 into container 3. This relationship is best seen in FIG. 3. Flexible tab 23 is shown in dotted line in its inwardly flexed position and in solid line in its outwardly expanded position.

Figure 7:
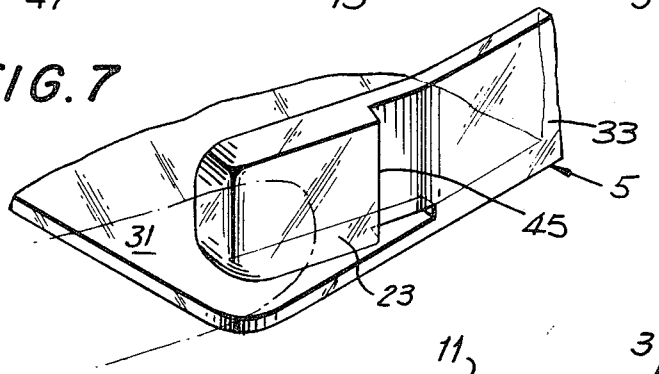
FIG. 7 is a partial perspective view of the tray of this invention, isolated from the container, showing the manner in which the flexible tabs of this invention can be compressed inwardly.
Figure 6:
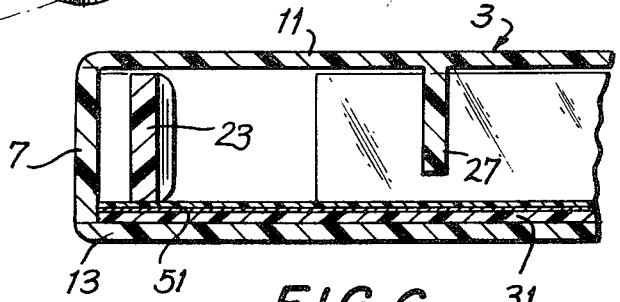
FIG. 6 is a partial cross-sectional view of the package shown in FIG. 5 taken along line 6—6 of FIG. 5.

To slide tray 5 out of container 3, tab 23 and 25 are simultaneously pressed inwardly by the thumb and index finger of one hand. This movement can best be seen in FIG. 7 which shows the tray 5 isolated from container 3. While tabs 23 and 25 compressed inwardly as shown in FIG. 7, pull tab 37 is gripped with the fingers of the other hand and tray 5 is withdrawn a distance out of the container.

With tray 5 in its partially withdrawn position shown in FIG. 4, the tablets can be dispensed from the blister pack without taking it out of tray 5. This is done by applying pressure to the blister 53 with a finger as illustrated in FIG. 4. This pressure ruptures the lower frangible layer 51 of the blister pack and the tablets 47 fall out.

This invention may be embodied in other specific forms without departing from the spirit or essential characteristics thereof. The present embodiments are therefore to be considered in all respects as illustrative and not restrictive. The scope of the invention is indicated by the appended claims.

What is claimed is:

1. A child resistant package comprising an outer container and an inner product supporting tray; said inner tray being adapted to be inserted into said container to a locked position and removed therefrom by disengaging a locking means and withdrawing the tray from said container;

(a) said container having side walls spaced apart from each other, each of which has front and back margins; said container also having a roof and floor joined to said container side walls; said container roof and floor also being provided with front and back margins; said container being open at its front and back end and the back margin of said container roof and floor being spaced backwardly from he back margins of said container side walls;

(b) said product supporting tray having a bottom and a pair of tray side walls that are joined to said tray bottom and extend upwardly therefrom, each of said tray side walls being provided with a slot cut through its back margin that extends partway forwardly in said tray side walls to form a flexible tab adapted to be flexed inwardly;

(c) each of said flexible tabs being provided with a protruding surface which causes said tab to be flexed inwardly when said tray is inserted into container until it reaches beyond said back margins of said container side walls at which time said tab returns to its unflexed position and serves to lock said tray in said container.

2. A child resistant package according to claim 1 in which the package is dimensioned so that it is beyond the capability of the average small child to depress both of said tabs at the same time to disengage said tray from said container.

3. A child resistant package according to claim 1 including a blister pack containing a plurality of tablets, said blister pack being positioned on said product supporting tray.

4. A child resistant package according to claim 3 in which said tray bottom is provided with a plurality of openings that are dimensioned and positioned so as to register with the tablets contained in said blister pack disposed on said tray whereby when the tray is at least partially withdrawn from said container, the tablets may be dispensed through the openings in said tray without removing the blister pack therefrom by applying enough pressure to the top of the tablets contained in the blister pack to rupture the blister pack and push the tablets through said openings in said tray.

5. A child resistant package according to claim 4 in which said tray is provided with product retaining tabs positioned adjacent the front and back margins thereof to prevent the blister pack from sliding off the tray when the package is held with its open ends aligned in a vertical position.

6. A child resistant package according to claim 5 in which said tray and said container are provided with cooperating stop means which engage each other when the tray is pulled out of the container at a distance sufficient to give access to all of the tablets contained in said blister pack.

7. A package according to claims 1, 2, 3, 4, 5, 6 or 7 which takes the form of a flat pack that may be conveniently carried in a pocket or a handbag.

* * * * *